US005523932A

United States Patent [19]

Bogdanovs

[11] Patent Number: 5,523,932

[45] Date of Patent: Jun. 4, 1996

[54] LIGHTING FIXTURE WITH ADJUSTABLE REFLECTOR

[75] Inventor: Andris Bogdanovs, deceased, late of Liverpool, N.Y., by Marilee Bogdanovs, legal representative

[73] Assignee: Cooper Industries, Inc., Houston, Tex.

[21] Appl. No.: 398,261

[22] Filed: Mar. 3, 1995

[51] Int. Cl.[6] ..... F21V 17/02

[52] U.S. Cl. ..... 362/282; 362/322; 362/370

[58] Field of Search ..... 362/187, 319, 362/322, 323, 269, 277, 280, 282, 285, 287, 370, 418, 288, 274, 35

[56] References Cited

U.S. PATENT DOCUMENTS

| | | | |
|---|---|---|---|
| 4,212,051 | 7/1980 | Kulik | 362/287 |
| 4,449,170 | 5/1984 | Warshawsky | 362/413 |
| 4,449,171 | 5/1984 | Warshawsky | 362/269 X |
| 4,527,224 | 7/1985 | Sangiamo et al. | 362/282 |
| 4,924,365 | 5/1990 | Bogdanovs | 362/282 X |

*Primary Examiner*—Denise L. Gromada
*Assistant Examiner*—Thomas M. Sember
*Attorney, Agent, or Firm*—Eddie E. Scott; William B. Patterson; Charlie E. Neff

[57] ABSTRACT

A lighting fixture with an adjustable reflector that will move to many different positions relative to the lamp and can be installed without tools and adjusted between positions with only one hand. The invention operates with an outwardly facing set of V-shaped notches at a first end of the lamp which mate with and an inwardly facing set of biased fingers at a first end of the reflector. The reflector is adjusted by manipulating it in a radial direction, thereby causing the biased fingers of the reflector to move across the V-shaped notches at the first end of the lamp.

2 Claims, 3 Drawing Sheets

LIGHTING FIXTURE WITH ADJUSTABLE REFLECTOR

BACKGROUND OF INVENTION

The present invention relates to an adjustable lighting fixture; more particularly, the present invention relates to a lighting fixture with a reflector that can be easily installed and adjusted with one hand between a number of different position relative to a lamp. Lighting fixtures of the type addressed by the invention are commonly used through out industry and typically include at least one high intensity lamp. A reflector is included to direct light to a particular area. Adjustable reflectors allow the user to redirect the light where it is needed for a particular job, avoiding the need for an additional lamp or relocation of an existing fixture. In prior art lighting fixtures, the reflectors are sometimes adjustable but require tools for adjustment, making quick adjustments impractical. For example, one prior art reflector requires the loosening of a fastener, adjustment of the reflector and then re-tightening of the fastener.

There is a need therefore, for a lighting fixture with an adjustable reflector that can be easily installed and moved between many positions without the need for tools.

There is a further need therefor, for a lighting fixture with an adjustable reflector that can be adjusted between many different positions with only one hand.

SUMMARY OF INVENTION

The present invention is for a lighting fixture with an adjustable reflector that will move to many different positions relative to the lamp and can be installed without tools and adjusted with only one hand. The invention operates with an outwardly facing set of V-shaped notches at a first end of the lamp which mate with and an inwardly facing set of biased fingers at a first end of the reflector. The reflector is adjusted by manipulating it in a radial direction, thereby causing the biased fingers of the reflector to move across the V-shaped notches at the first end of the lamp. At each position, the reflector is held in place by the V-shaped notches and the teeth with no need for tightening a fastener. In the preferred embodiment, there are guide grooves which guide the fingers into contact with the V-shaped notches as the reflector is installed onto the fixture.

DESCRIPTION OF AN EMBODIMENT

Figure 1:
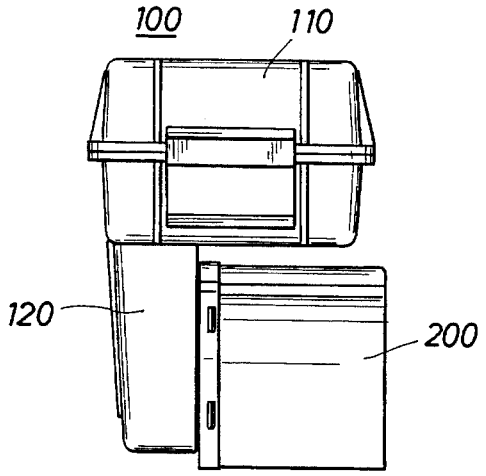
FIG. 1 is a side view of the lighting fixture and reflector of the present invention.
Figure 2:
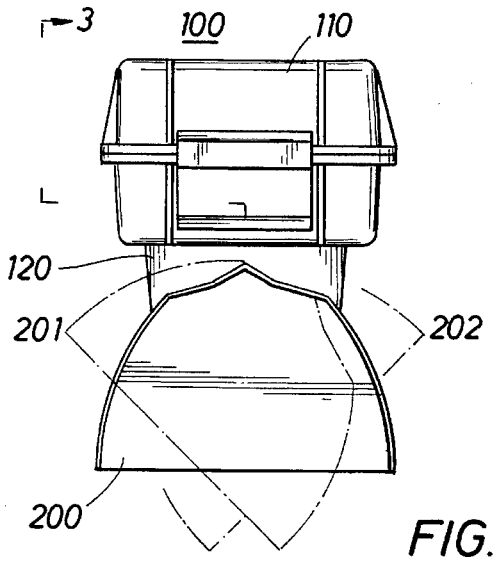
FIG. 2 is a front view showing the rotational positions of the reflector.
Figure 3:
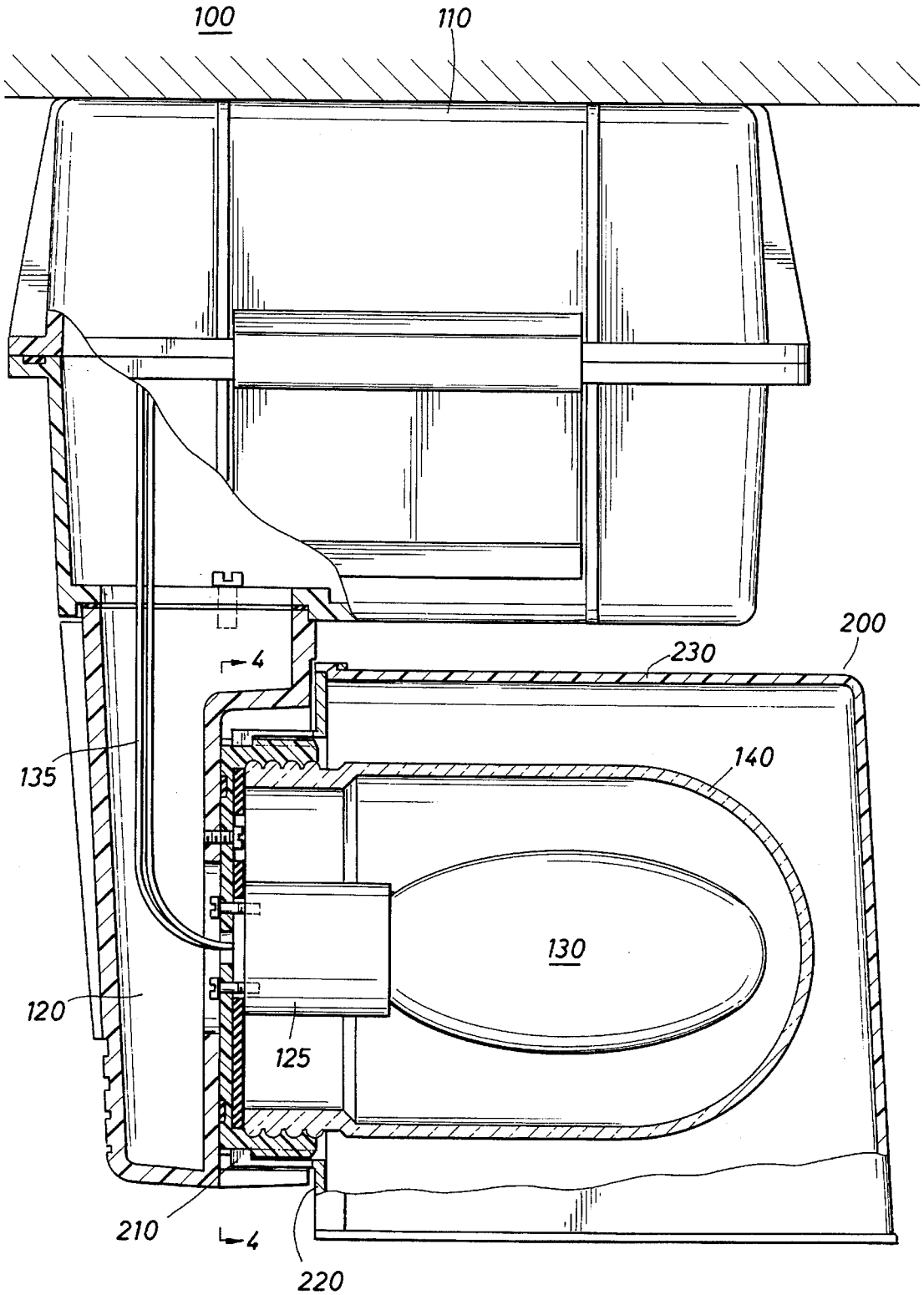
FIG. 3 is a side view, partially in section of the fixture.

The lighting fixture of the present invention can be best understood by reference to the Figures. As shown in FIG. 1, the fixture 100 includes a housing 110, an arm 120 extending downward therefrom and a reflector 200 attached to arm 120. FIG. 2 demonstrates the rotational capabilities of the reflector 200 from a first extreme 201 to a second extreme 202. FIG. 3 is a side view, showing additional portions of the fixture 100. Arm 120 includes an electrical socket 125 into which lamp 130 is inserted. Electrical wires 135 provide power from the housing to the lamp. Protective globe 140 threads into arm 120 and protects lamp 130 from accidental breakage.

Figure 7:
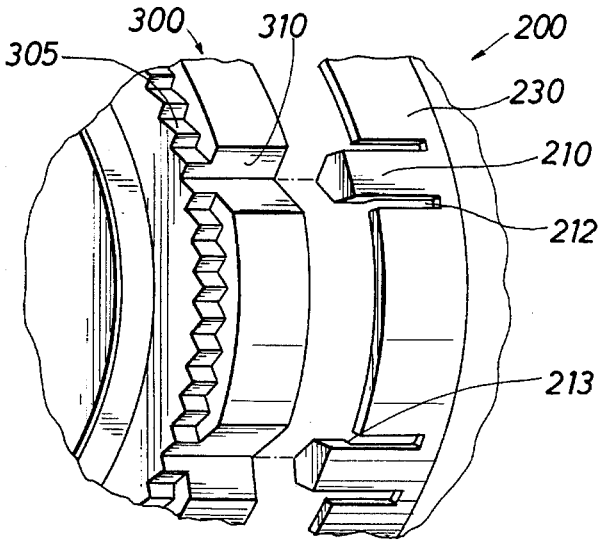
FIG. 7 is an exploded view showing the V-shaped notches and prongs before assembly.

The subject of the invention surrounds the interface between the reflector 200 and the arm 120. FIG. 7 shows the first end 230 of the reflector 200 and the connection portion 300 of the arm 120. Reflector 200 is installed onto the arm 120 through the action of a number of prongs 210, grooves 310 and V-shaped notches 305. FIG. 7 depicts Located around the first end 230 of reflector 200 are a number of prongs 210 having sides formed by slots 212 to provide spring-like characteristics to the prongs. Mounting portion 300 of arm 120 includes a number of grooves 310 formed around the end of mounting portion 300. Groves 310 are arranged to act as guides allowing the prongs 210 to slide onto mounting portion 300 of the arm 120.

Figure 8:
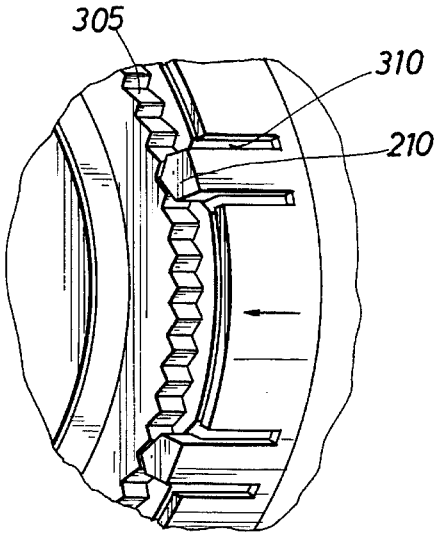
FIG. 8 is an exploded view showing the V-shaped notches and prongs during assembly.

FIG. 8 shows the relation between reflector 200 and arm 120 after the reflector has been installed on the arm. Prongs 210 have been guided by grooves 310 onto the mounting portion 300 of the arm 120 and have engaged with V-shaped notches 305 located around the perimeter of the mounting portion 300.

Figure 4:
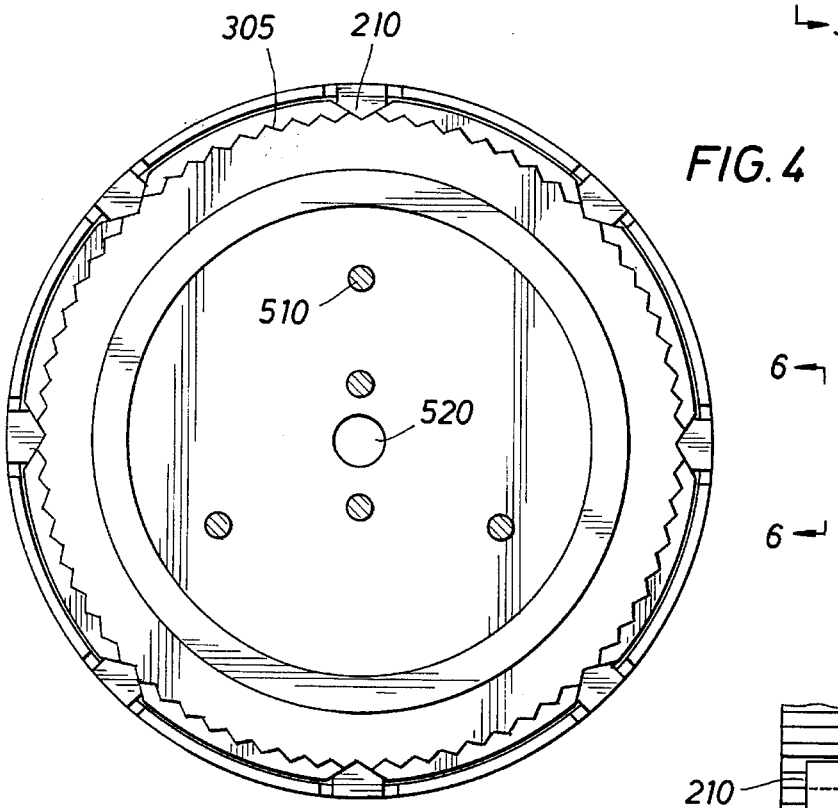
FIG. 4 is a section view of the fixture showing engagement between the V-shaped notches and prongs.
Figure 6:
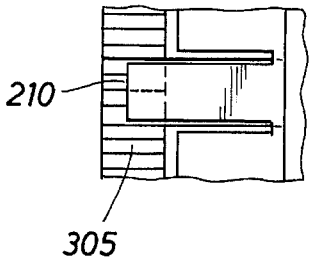
FIG. 6 is a detail view showing the V-shaped notches and prongs.
Figure 5:
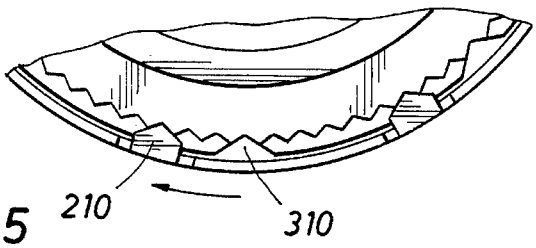
FIG. 5 is a section view illustrating the movement between the prongs across the V-shaped notches.
Figure 9:
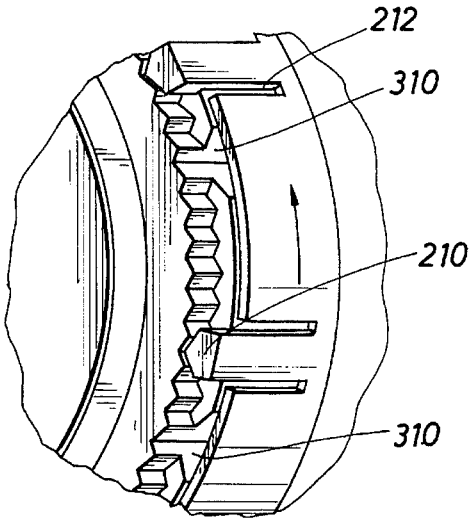
FIG. 9 is an exploded view showing the rotational movement of the V-shaped notches and the prongs.

FIG. 9 demonstrates the rotational movement that is allowed between the reflector and the arm after the reflector has been mounted. The under surface 212 of each prong 210 is held on surface 305 thereby preventing the removal of the reflector unless prongs 210 are aligned with grooves 310. As depicted, the reflector has rotated in a counterclockwise direction causing the prongs 210 to move across V-shaped notches 305 and away from the grooves 310. FIG. 5 is an end view showing the relation between the grooves and the prongs 210. FIG. 4 is a sectional view illustrating the relation between the prongs 210 and the V-shaped notches 305. As shown, the V-shaped notches 305 are equally spaced whereby each prong 210 is engaged in a tooth 305. In the preferred embodiment there are 8 prongs. Also shown are several mounting holes 510 and access hole 520 for electrical wires 135.

While the lighting fixture of the present invention has been described by reference to its preferred embodiment, it will be understood that other various embodiments of the device may be possible by reference to the specification and the appended claims. Such additional embodiments shall be included within the scope of the appended claims.

I claim:

1. An adjustable connection system between a lamp housing and a reflector, said connection system comprising:

a cylindrical portion formed on said lamp housing, said portion having a first surface with a plurality of V-shaped notches formed around a first perimeter thereof and an outer surface, of greater diameter than said first surface having a plurality of V-shaped grooves formed therein, each of said V-shaped grooves aligned with one of said V-shaped notches and having substantially the same depth as said V-shaped notches;

a substantially cylindrical engagement portion at an end of said reflector, said engagement portion including a plurality of inwardly facing, spring-like engagement prongs around a second perimeter thereof, said engagement prongs constructed and arranged to engage said grooves of said outer surface portion whereby said grooves guide said prongs into engagement with said V-shaped notches of said outer surface portion as said reflector is installed axially onto said lamp housing.

2. The adjustable connection system in claim 1, whereby as said reflector is rotated by hand, said inwardly facing engagement prongs move across said V-shaped notches moving said reflector between a plurality of radial positions with respect to said lamp and retaining said reflector in any of said plurality of radial positions.

* * * * *